US006691318B1

(12) United States Patent
Davis

(10) Patent No.: US 6,691,318 B1
(45) Date of Patent: Feb. 17, 2004

(54) EXERCISE VEST

(76) Inventor: Everton Davis, 612 Glade Ave. #B109, Woodland Hills, CA (US) 91367

( * ) Notice: Subject to any disclaimer, the term of this patent is extended or adjusted under 35 U.S.C. 154(b) by 46 days.

(21) Appl. No.: 10/179,838

(22) Filed: Jun. 24, 2002

(51) Int. Cl.[7] ..... A41D 1/04
(52) U.S. Cl. ..... 2/102; 482/124
(58) Field of Search ..... 2/102, 2.5, 462, 2/69, 300, 310, 44, 326, 327; 482/130, 92, 69, 124, 74, 125, 105, 44–49, 110, 121, 122

(56) References Cited

U.S. PATENT DOCUMENTS 1,402,179 A * 1/1922 Piscitelli ..... 482/124
3,162,441 A * 12/1964 Karlik ..... 482/124
4,961,573 A * 10/1990 Wehrell ..... 482/74
5,358,461 A * 10/1994 Bailey, Jr. ..... 482/2
5,792,034 A * 8/1998 Kozlovsky ..... 482/124
5,916,070 A * 6/1999 Donohue ..... 482/74

* cited by examiner

*Primary Examiner*—Tejash Patel
(74) *Attorney, Agent, or Firm*—Goldstein Law Offices, P.C.

(57) ABSTRACT

An exercise vest used to facilitate strengthening and toning of the user's upper arm, lower arm, and shoulder muscles. At least one hand grip is positioned on the back portion of the vest. The hand grips include shoulder grips and side grips. An elastic band extends between one of the shoulder grips and one of the side grips, along the vest back portion. The elastic band provides the tension necessary for exercising the user's arm muscles. A ring encircles the elastic band at a point below the hand grips to maintain the hand grips in their resting positions on the vest. A sleeve extends between the shoulder grip and side grip, covering the elastic band. In use, the user grips one set of the hand grips and pulls said grips forward and away from his or her body. The stretching of the elastic band serves to exercise the muscles.

7 Claims, 3 Drawing Sheets

EXERCISE VEST

BACKGROUND OF THE INVENTION

The invention relates to an exercise vest. In particular, the invention is a vest that is worn around a person's torso to facilitate the performance of arm toning exercises.

Exercise is a preferred pastime for people of all ages. Besides exercising to stay in shape and lose weight, people exercise to build muscles and relieve stress. One of the most popular body parts in which a person attempts to tone and build up muscle is in the arms, particularly the biceps, triceps and shoulders. Unfortunately, it is difficult to tone muscles, especially the arm area, without the use of weights. Accordingly, people are limited as to where they can effectively tone their arms.

Thus, there exists a need for an exercise device that allows the arms to be toned and can be used anywhere. Said device is intended to target the arm areas, enabling a user to tone and build up muscles in the bicep, tricep and shoulder regions of the arm.

While the exercise units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved exercise vest. As such, the general purpose of the present invention, which will be described subsequently in greater detail, is to provide a new and improved exercise vest which has all the advantages of the prior art and none of the disadvantages.

To attain this, the present invention essentially comprises an exercise vest used to facilitate strengthening and toning of the user's upper arm and shoulder muscles. At least one hand grip is positioned adjacent to the back portion of the vest. The hand grips include shoulder grips and side grips. An elastic band extends between each of the shoulder grips and one of the side grips, vertically along the vest back portion. The elastic band provides the tension necessary for exercising the user's arm muscles. A pair of rings encircle each of the elastic bands and limit the motion of the hand grips at the shoulders and at the sides. A sleeve extends between the shoulder grip and side grip, selectively covering the elastic band. In use, the user grips one set of the hand grips and pulls said grips forward and away from his or her body. The other set of hand grips are pulled toward their rings and cause the elastic band to become tensioned by the continued pulling by the user of the grips. The stretching of the elastic band serves to exercise the muscles.

It is an object of the invention to produce an exercise vest that can be utilized to tone and build up muscles in the arm regions of the body. Accordingly, the vest has strategically positioned hand grips that aid the user in exercising his or her biceps, triceps and shoulders.

It is a further object of the invention to produce an exercise vest that allows the user to enjoy a workout without the use of weights. Accordingly, the elastic bands provide sufficient resistance during toning exercises and is sufficiently anchored by the user's own body using the vest worn around the user's torso.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

Figure 1:
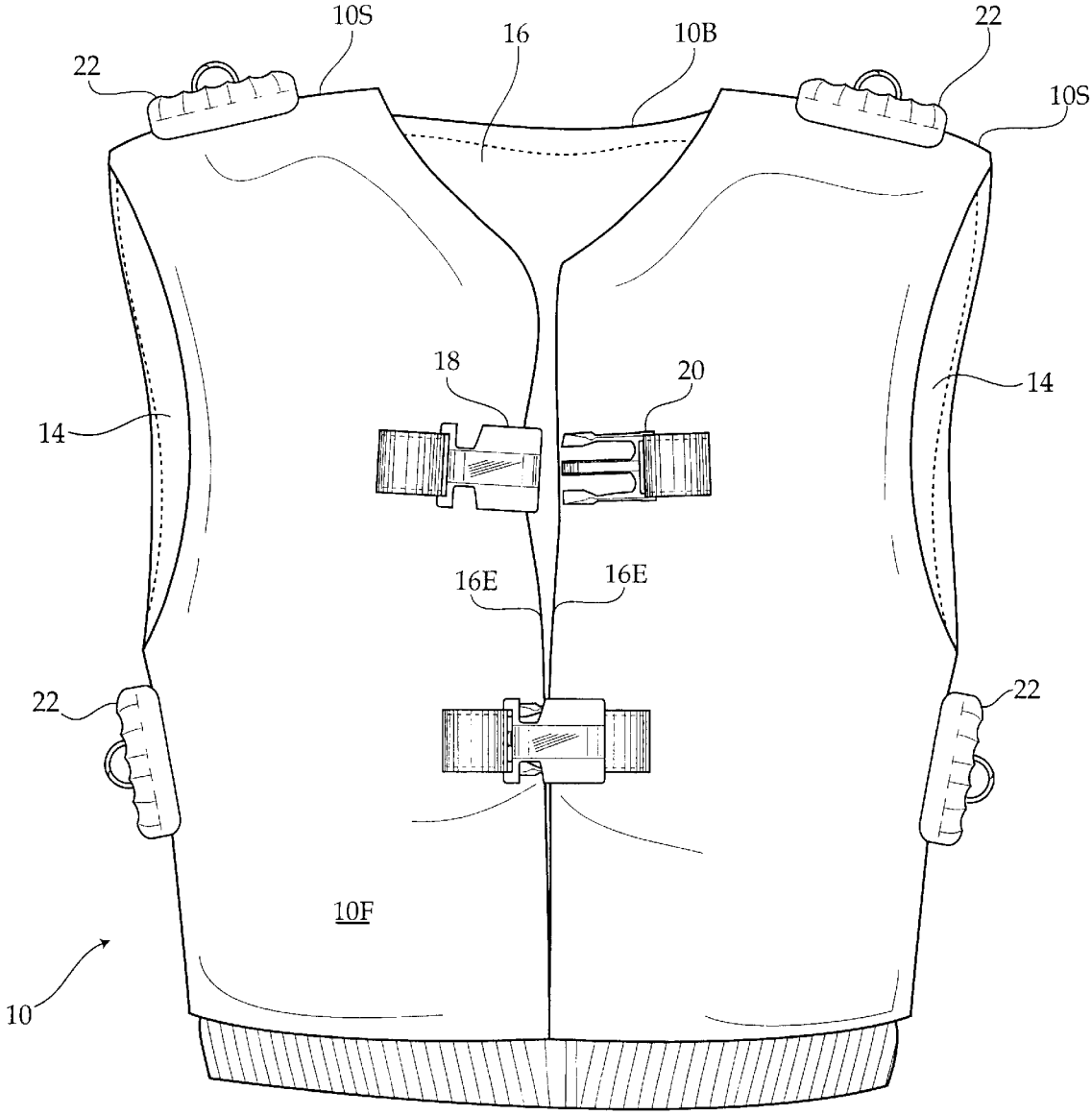
FIG. 1 is a front elevational view of the exercise vest.

| REFERENCE NUMERALS | |
|---|---|
| 10 | exercise vest |
| 10F | front portion of exercise vest |
| 10B | back portion of exercise vest |
| 10S | shoulder portion of exercise vest |
| | user |
| 12T | user's torso |
| 12A | user's arm |
| 12C | user's chest |
| 12B | user's back |
| 12H | user's hand |
| 12S | user's shoulder |
| 14 | arm opening |
| 16 | front opening |
| 16E | front opening vertical edge |
| 18 | female coupling |
| 20 | male coupling |
| 22 | elastic band |
| 24 | shoulder grip |
| 26 | side grip |
| 28T | top ring |
| 28S | side ring |
| 29 | ring split |
| 30 | sleeve |
| 30S | sleeve stitched end |
| 30F | sleeve free end |
| 32 | fastener material |

DETAILED DESCRIPTION OF THE PREFERRED EMBODIMENTS

FIG. 1 illustrates an exercise vest 10. The vest 10 is worn by a user 12. The user has a torso 12T, a chest 12C, a back 12B, a pair of hands 12H, an upper arm area 12A, and a pair of shoulders 12S. The vest 10 is worn around the user's torso 12T, and used to facilitate the strengthening and toning of the user's upper and lower arm areas 12A.

The vest 10 essentially comprises a front portion 10F which extends anteriorly when worn, said portion 1OF resting against the user's chest 12C, a back portion 10B resting against the user's back 12B, and a pair of shoulder portions 10S which extend over the user's shoulders 12S. The vest 10 further comprises a pair of arm openings 14 and a front opening 16 situated along the center of the front portion 10F. The front opening 16 has two vertical edges 16E that, when the front portion 10F of the vest is closed, said edges 16E are brought together. At least one female coupling 18 is positioned adjacent to one of the front opening vertical edges 16E. A corresponding male coupling 20 is positioned on the opposite vertical edge 16E, wherein the male coupling 20 is selectively mateable with the female coupling 18 to secure the vest 10 on the user.

Figure 2:
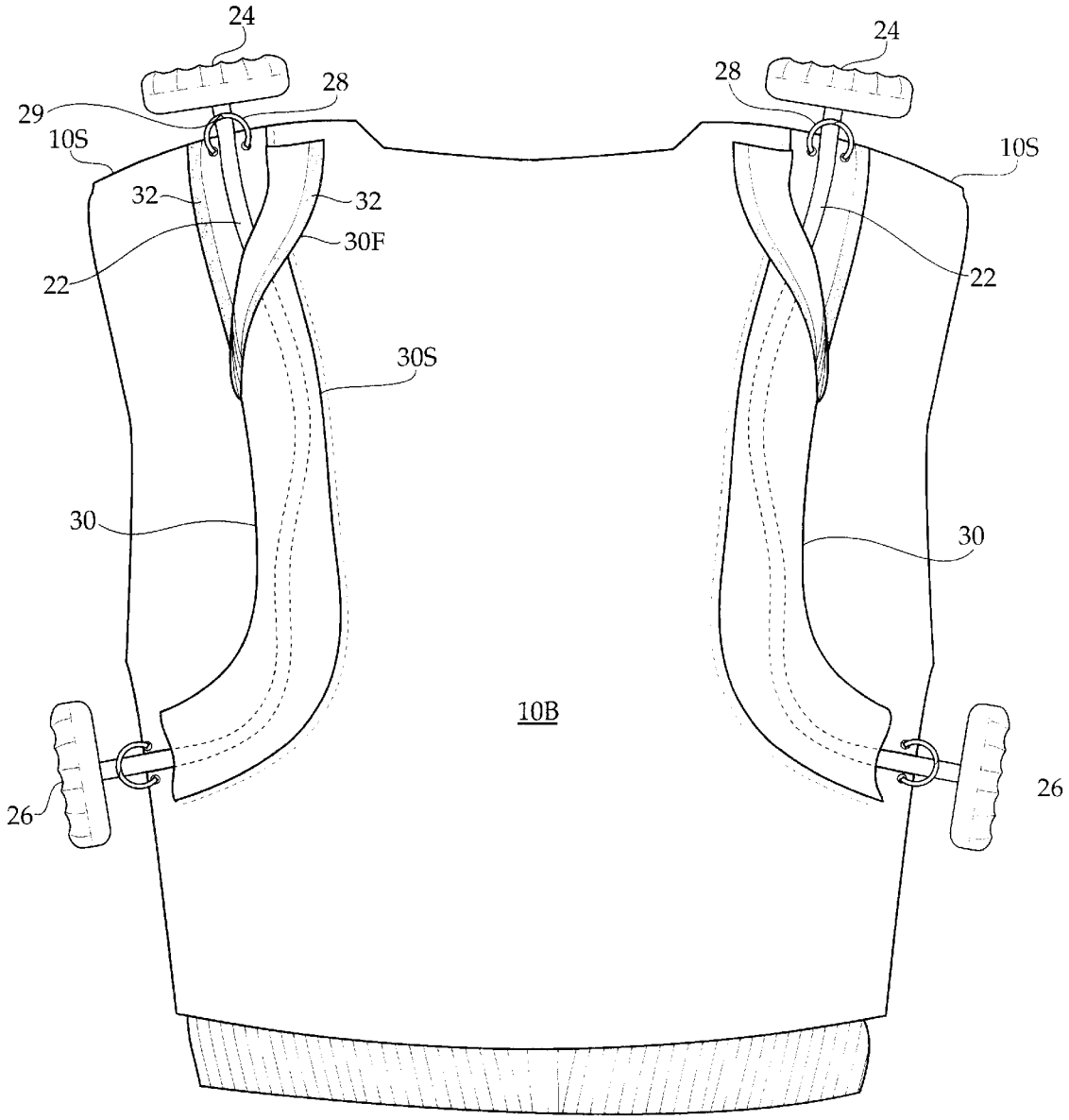
FIG. 2 is a rear elevational view of the exercise vest.

Referring to FIG. 2, a plurality of hand grips are positioned adjacent to the back portion 10B. In particular, a pair of a shoulder grips 24 are provided. Each shoulder grip 24 is situated on one of the shoulder portions 10S, and a side grip 26 is situated under each of the arm openings 14. An elastic band 22 extends between each of the shoulder grips 24 and each of the side grips 26. The elastic band 22 provides the resistance necessary for exercising the user's arm muscles. A pair of top rings 28T encircle the elastic bands 22 at a point rearward and below the shoulder grips 24, when said shoulder grips 24 are in a resting position. The top rings 28T are anchored through the vest 10, said rings 28 maintaining the shoulder grips 24 in their positions on the shoulder portions 10S when the side grips 26 are pulled. Similarly, a pair of side rings 28S which encircle the elastic bands 22 at a point rearward of the side grips 26 when the side grips 26 are at their resting positions. The side rings 28S are anchored to the vest 10 and maintain the side grips 26 in position when the shoulder grips 24 are pulled.

A sleeve 30 extends between the shoulder grip 24 and side grip 26, said sleeve 30 selectively covering the elastic band 22. The sleeve 30 is open at the top and at the side to allow the elastic band 22 to move freely therethrough. In particular, the sleeve 30 extends vertically, having a stitched end 30S and a free end 30F. The free end 30F is selectively mated with the rear of the vest with fastener material 32. In addition, the rings 28T, 28S have a split 29 which allows them to selectively open like a "loose-leaf" binder to allow the elastic band 22 to be removed. Thus, to replace the elastic band 22, the rings 28T, 28S are opened and the free end 30F of the sleeve 30S is pulled from the rear of the vest 10. Once a replacement elastic strip is suitably positioned, the rings 28T, 28S are closed and the sleeve 30 is closed to conceal the band 22.

Figure 3:
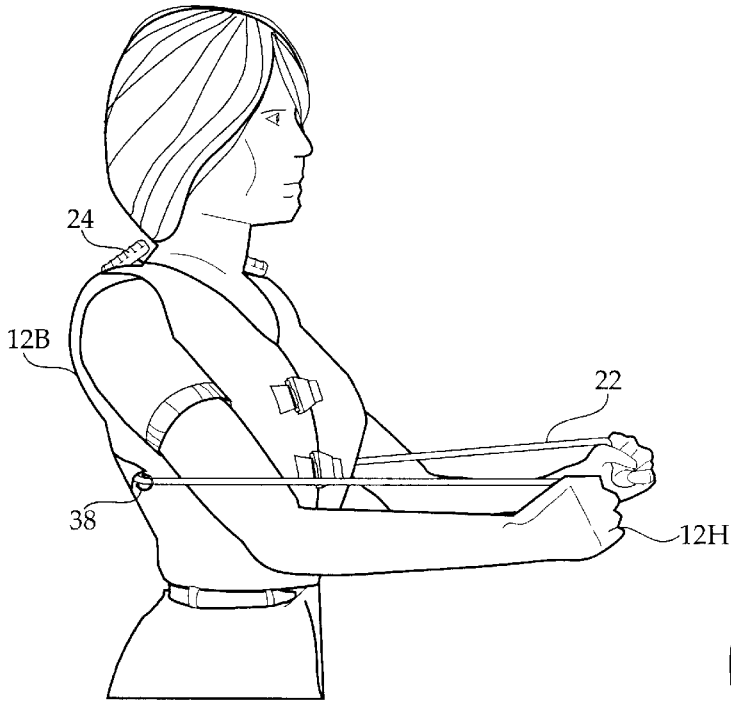
FIG. 3 is a side perspective view of the exercise vest in use, wherein the user is pulling the side grips.
Figure 4:
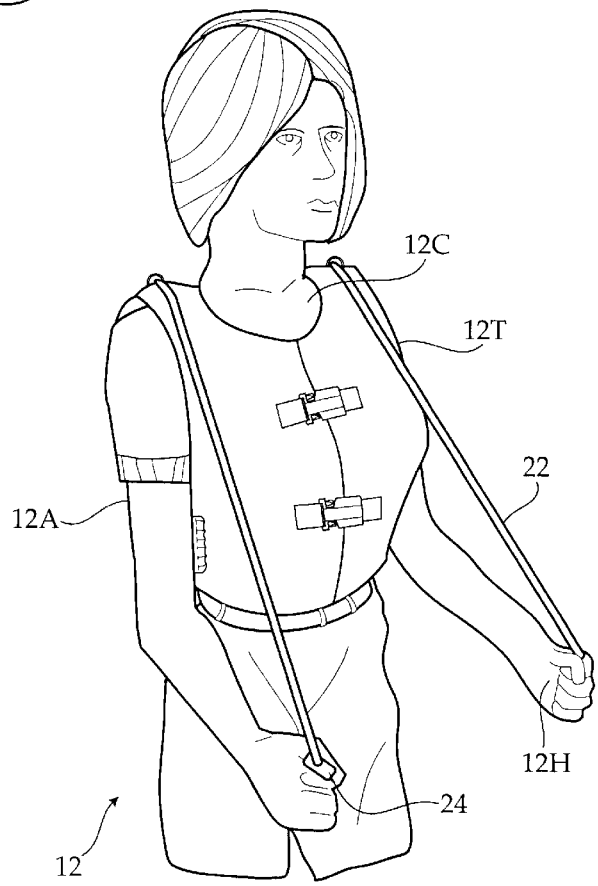
FIG. 4 is a front perspective view of the exercise vest in use, wherein the user is pulling the shoulder grips.

In use, the vest 10 is placed around the user's torso 12T, with the user's arms 12A extending through the arm openings 14 of said vest 10. The male extension 20 on the front portion 10P of the vest 10 is mated with the corresponding female coupling 18 to ensure that the vest 10 remains in place on the user. The user then reaches his or her hands 12H to the vest back portion 10B and grips the side grips 26, as illustrated in FIG. 3. The arms 12A are then extended forward, past the user's chest 12C. This movement necessitates use of the bicep and triceps muscles to stretch the elastic band 22 as far as possible. Alternatively, the user grips the shoulder grips 24 and extends his or her arms 12A downward, thereby exercising the shoulder muscles. Sets of repetitions are performed to ensure maximum results.

In conclusion, herein is presented an exercise vest utilized to tone the user's arm muscles. The invention is illustrated by example in the drawing figures, and throughout the written description. It should be understood that numerous variations are possible, while adhering to the inventive concept. Such variations are contemplated as being a part of the present invention.

What is claimed is:

1. An exercise vest used to strengthen and tone a user's upper and lower arm areas, the vest worn around the torso, comprising:

the vest having a front portion, a back portion, a pair of shoulder portions, a pair of arm openings, and a front opening, wherein the front portion rests against the user's chest, the back portion rests against the user's back, the shoulder portions rest over the user's shoulders, and the arm opening sized to accommodate the user's arms;

a plurality of hand grips, the hand grips positioned on the back portion of the vest, said hand grips including a pair of shoulder grips and a pair of side grips, the shoulder grips situated on each of the vest shoulder portions and the side grips situated under each of the vest arm openings;

a pair of elastic bands, each elastic band extending along the back portion of the vest vertically between one of the shoulder grips and one of the side grips, said band providing tension when the hand grips is pulled; and four rings, each ring encircling the elastic band inward of each hand grip when the hand grips are in a resting position, said rings rigidly attached to the vest, wherein each ring maintains one of the hand grips attached to its associated elastic band in position so that the elastic band can be tensioned when the other hand grip attached to that elastic band is pulled by the user.

2. The exercise vest as recited in claim 1, further comprising a sleeve, the sleeve extending on the rear of the vest between the shoulder grip and the side grip, said sleeve covering the elastic band extending therebetween.

3. The exercise vest as recited in claim 2, wherein the sleeve has a stitched end and a free end, the free end having fastener material extending adjacent thereto, the rear of the vest also having fastener material, selectively allowing the elastic band to be removed from the sleeve and selectively concealed by the sleeve.

4. The exercise vest as recited in claim 3, wherein the rings have a split which allow the rings to be selectively opened to allow the elastic band to be removed.

5. The exercise vest as recited in claim 4, wherein the front opening has two vertical edges, wherein the front opening is closed when the edges are brought together.

6. The exercise vest as recited in claim 5, wherein the front opening further comprises at least one female coupling positioned adjacent to one of the front opening vertical edges and at least one corresponding male extension positioned on the opposite vertical edge, wherein the male extension is selectively mateable with the female coupling in order to hold the front opening of the vest closed.

7. A method of exercising a user's upper arm, lower arm and shoulder muscles using an exercise vest, the vest having a pair of arm openings, a back portion, a plurality of hand grips, the hand grips positioned on the the back portion of the vest, said hand grips including a pair of shoulder grips and a pair of side grips, the shoulder grips situated on each of the vest shoulder portions and the side grips situated under each of the vest arm openings and a front portion, said front portion having a front opening, at least one male extension and at least one corresponding female coupling, comprising the steps of:

a) placing the vest over the user's torso by inserting the user's arms through the arm openings;

b) closing the front opening of the vest by mating the male extension with the corresponding female coupling;

c) gripping one of the pair of shoulders grips and the pair of side grips by extending the user's hands toward the back portion of the vest;

d) tensioning a pair of elastic bands by pulling said hand grips forward and away from the user's torso;

e) repeating steps (c) and (d) to maximize exercising results.

* * * * *